United States Patent [19]

Tenenbaum

[11] Patent Number: 4,735,083

[45] Date of Patent: Apr. 5, 1988

[54] CONDUIT FOR DETECTING IMMINENT FAILURE

[75] Inventor: Martin Tenenbaum, Hartsdale, N.Y.

[73] Assignee: Dakten Products, Inc., Bronx, N.Y.

[21] Appl. No.: 903,451

[22] Filed: Sep. 4, 1986

Related U.S. Application Data

[63] Continuation-in-part of Ser. No. 532,368, Sep. 15, 1983, abandoned.

[51] Int. Cl.[4] ..... G01M 3/08

[52] U.S. Cl. ..... 73/40.5 R; 73/118.1; 138/36

[58] Field of Search ..... 116/206, DIG. 41, 207; 73/40.5 R, 40.7, 118.1; 138/36; 436/3, 170; 340/605

[56] References Cited

U.S. PATENT DOCUMENTS 3,299,417 1/1967 Sibthorpe ..... 73/49.1 X

FOREIGN PATENT DOCUMENTS 382548 8/1974 U.S.S.R. ..... 73/40.7

*Primary Examiner*—Jerry W. Myracle

*Attorney, Agent, or Firm*—David A. Jackson; Richard M. Goldberg; Barbara L. Renda

[57] ABSTRACT

Imminent failure of a hose or other conduit is detected by a dye disposed between the conduit's outer and inner walls. The invention is especially applicable to automotive cooling systems.

12 Claims, 1 Drawing Sheet

CONDUIT FOR DETECTING IMMINENT FAILURE

This is a continuation-in-part of U.S. application Ser. No. 532,368, filed Sept. 15, 1983, now abandoned.

BACKGROUND

My prior application, the entire content of which is incorporated herein by reference, discloses a system for diagnosing and preventing trouble with the cooling system of an internal combustion engine. The disclosed device comprises apparatus for monitoring the cooling system of a liquid-cooled internal combustion engine having a radiator and a conduit in fluid communication with an upper section of the radiator, said apparatus comprising:

(a) a housing adapted to be permanently mounted on the conduit at the same level as the upper section of the radiator such that liquid may flow through said housing;

(b) means for indicating the level of liquid within said housing, thereby providing an indication of the level of liquid within the upper section of the radiator; and (c) means for indicating the specific gravity of liquid within said housing.

As described in my prior application in detail, the device is fully capable of providing early diagnosis of many common faults in an automobile's cooling system. However, there is one common problem still not addressed by the apparatus of my prior application—diagnosis of imminent hose failure.

Whenever a hose in an automobile's liquid cooling system ruptures, it is a minor disaster. All or most of the coolant is immediately emptied from the system, and continued operation of the automobile thereafter will literally burn out the engine.

Prior techniques for detecting imminent failure of conduits are disclosed in:

U.S. Pat. No. 1,975,832 (drilling small holes to provide detectable leaks when the conduit is partially eroded), U.S. Pat. No. 3,911,959 (providing two-ply hose with transparent out ply), U.S. Pat. No. 4,153,079 (providing two-ply hose with outer ply that bulges when inner ply leaks), U.S. Pat. No. 4,119,123 (detecting wear in ribs located on the outer surface of a hose).

None of the above-listed techniques is particularly applicable to automobile cooling-system hoses.

U.S. Pat. No. 3,922,999 discloses a technique for detecting wear in a sight glass, but this also is not particularly useful for a car's cooling system.

SUMMARY OF THE INVENTION

The present invention provides a conduit for carrying liquid comprising a tube having an inner surface and an outer surface and a dye disposed between said surfaces, said dye being soluble in the liquid. To use the present invention, one merely checks the color of the liquid that has flowed or is flowing through the conduit. When the liquid starts to acquire the color of the dye, one knows that failure of the conduit is imminent and that the conduit should be replaced.

The invention is particularly useful in combination with the device of my prior application.

DETAILED DESCRIPTION OF THE INVENTION

Figure 3:
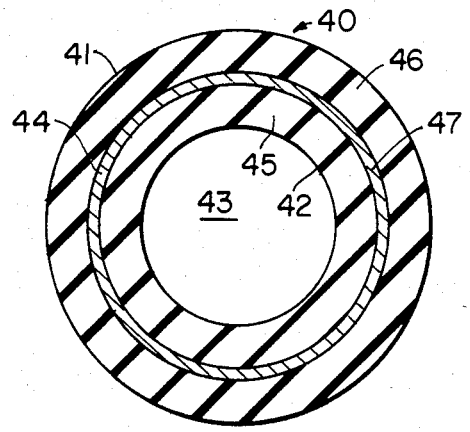
FIG. 3 is a cross-sectional view af a conduit in accordance with the present invention.

The present invention in its broadest aspects is shown in FIG. 3. A conduit 40 has an outer surface 41 and inner surface 42. Liquid flows in enclosed hollow interior 43. Dye 44 is disposed between inner surface 42 and outer surface 41. The dye is soluble in the liquid that the conduit is expected to carry. The conduit may be constructed of any material, but the invention is especially adaptable for flexible conduits, such as automobile cooling system hoses, which are more likely to wear out than inflexible conduits, such as steel pipes.

Prior-art automobile hoses are constructed of two plies of flexible material, i.e. inner ply 45 and outer ply 46, with a reinforcing fabric ply 47 between the two plies. To practice the invention with this construction, fabric ply 47 is impregnated with dye.

Conduits in accordance with the invention are installed in the usual manner and used as follows. Periodically the color of the liquid that has flowed through the conduit is checked by the user. When a portion of inner ply 45 has eroded away or striated so that the liquid contacts fabric ply 47, the dye from the fabric ply dissolves in the liquid causing it to acquire the color of the dye.

The choice of dyes used in practicing the invention is quite flexible, the only requirement being that the dye impart its color to the liquid flowing in the conduit, when the inner portion of the conduit has worn away so that the liquid contacts the dye. Thus for a conduit carrying liquid containing a substantial amount of water, such as engine coolant, water-soluble dyes will suffice. Hence the following dyes could be used:

Methylthione Chloride (blue)
Cobaltous ammonium sulfate (red)
Cupric chloride (green)
Methyl violet (violet).

Even substances that are not oridinarily considered dyes may be used. For example, instant coffee powder would impart a brown color to hot engine coolant. Many commercial antifreezes already contain a dye to impart a pleasant color. In this regarfd, a pH sensitive dye can be used to change the color of the antifreeze when contacted thereby.

The dye may be disposed between the inner and outer walls of the hose in any suitable manner. For example, in FIG. 3, reinforcing fibre 47 could be impregnated with dye by soaking in a concentrated dye solution. Alternatively, the inner surface of outer ply 46 or the outer surface of ply 45 could be coated with a dye paste, and the paste allowed to dry. Then the inner ply and fabric could be inserted into the space enclosed by the paste.

For systems having many hoses it is desirable to dispose a different color dye in each hose. That way, when the fluid becomes colored, the user will know, depending on the color of the fluid, which hose is in danger of failing.

Figure 1:
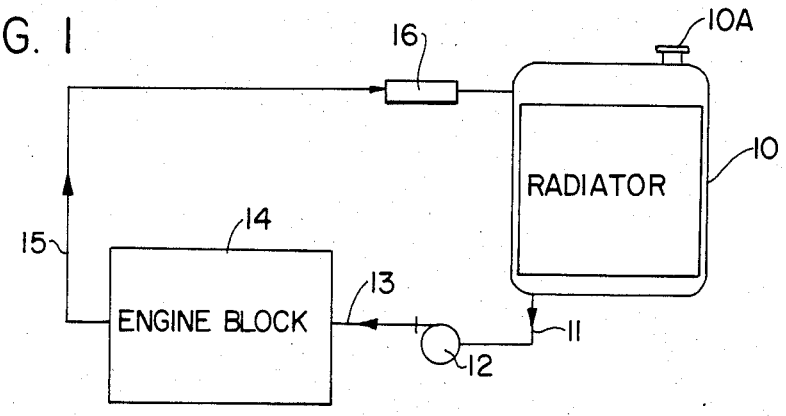
FIG. 1 is a schematic view of an engine cooling system showing typical locations of hoses.

FIG. 1 schematically shows an automobile engine cooling system. Antifreeze flows from radiator 10 through hose 11, through pump 12, through hose 13, through engine block 14, through hose 15, and back into radiator 10. In accordance with the invention, a kit of hoses 11, 13, and 15 would be provided, with each hose having dye disposed between its inner and outer walls. More preferably each hose would have a different color dye, for example, hose 11, blue; hose 13, red; and hose 15, green. If the car's owner knew which color dye was in each hose, he would then now which hose to replace when the anti-freeze became colored.

To ascertain the color of the antifreeze, the owner could remove radiator cap 10A. However, the cap should not be removed when the engine is hot. To permit viewing the antifreeze at anytime, it is preferable to have a means for viewing the color of the liquid installed in one of the conduits. A sight glass in one of the conduits will suffice.

Figure 2:
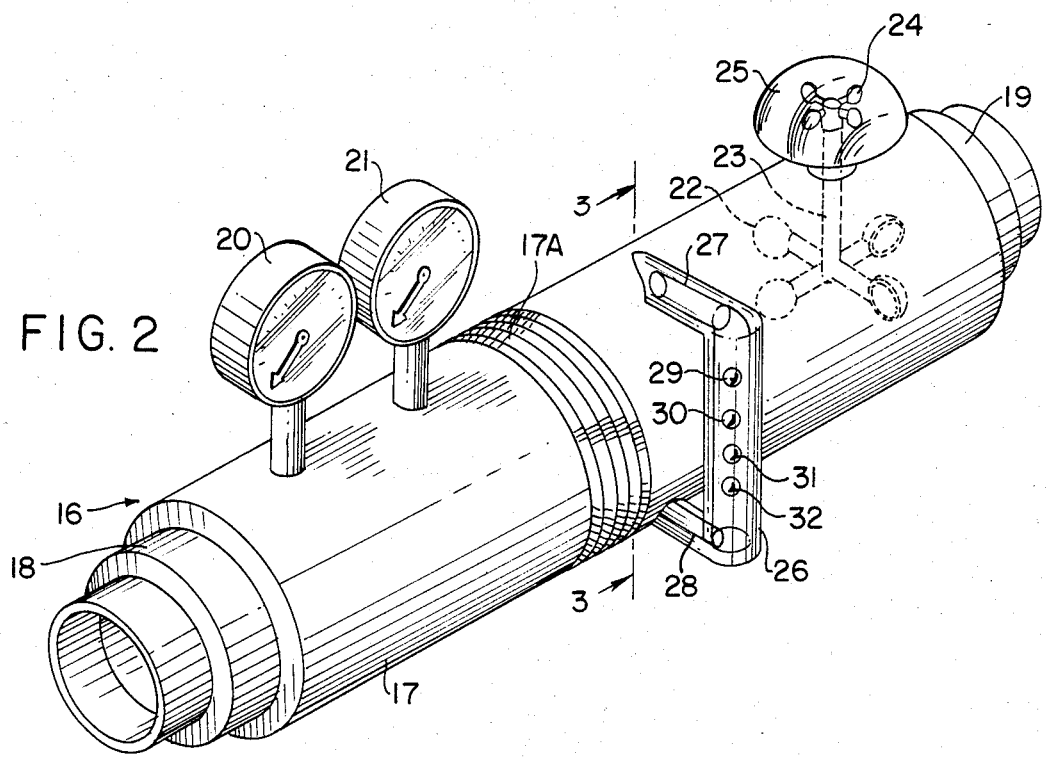
FIG. 2 is an isometric view of the cooling system of my prior application, which may be conveniently used with the present invention.

Instead of just a sight glass, is is even better to use the device 16 described in my previous application, shown in detail in FIG. 2. housing 17 is in fluid communication with a clear sight glass 26. The housing is mounted in a hose 15 that enters radiator 10 near the top of the radiator. This way the level of antifreeze in the radiator can be ascertained in sight glass 26. Means for indicating the specific gravity of the antifreeze are also provided. For example, objects 29, 30, 31, and 32 each have different specific gravity. The specific gravity of the antifreeze can then be determined quickly by counting the number of objects 29 to 31 that float in the sight glass. An optional thermometer 20, pressure gage 21 and/or flow indicating rotor 24 may also be provided to give the car's owner a rapid check on his cooling system's performance without the need to remove the radiator cap or to use other instruments.

It can be seen that this invention provides a means to detect imminent conduit failure that can be used for any conduit. It is especially suitable for automobile cooling system hoses. When combined with the invention of my prior application it provides an inexpensive way to quickly analyze the performance of the automobile's cooling system.

What is claimed is:

1. a conduit for carrying liquid, consisting essentially of:

a tube including an inner ply through which said liquid is intended to travel and a surrounding oute rply separated by an unpressurized space therebetween; and a dye disposed within said space for changing the color of said liquid upon contact therewith when said liquid travels in said space upon the occurrence of a break in said inner ply.

2. The conduit of claim 1, wherein said tube is constructed of a flexible material.

3. The conduit of claim 1 wherein said dye is soluble in the liquid.

4. The conduit of claim 1 wherein said dye is pH sensitive to change the color of said liquid upon contact therewith.

5. A conduit for carrying liquid, comprising a tube constructed of flexible material, said tube having an inner surface, an outer surface, outer and inner plies of flexible material and a reinforcing fabric between said inner and outer plies, and said fabric is impregnated with a dye disposed between said surfaces for changing the color of said liquid upon contact therewith.

6. A conduit for carrying liquid comprising:

a tube having an inner surface and an outer surface;

a dye disposed between said surfaces for changing the color of said liquid upon contact therewith; and means for viewing the color of liquid flowing through said conduit.

7. For use with a cooling system of an internal combustion engine, the improvement comprising a plurality of hoses for connection with the cooling system for carrying a cooling liquid, each hose comprising:

a tube including an inner ply through which said liquid is intended to travel and a surrounding outer ply separated by an unpressurized space therebetween;

at least one tube constructed of a flexible material; and a dye disposed within said space for changing the color of said liquid upon contact therewith when said liquid travels in said space upon the occurrence of a break in said inner ply.

8. The hoses of claim 7 wherein at least two of said hoses have dye disposed between their inner and outer plies, and each hose contains dye of a different color.

9. The hoses of claim 7 wherein one of said hoses is adapted for installation in fluid communication with an upper section of a radiator in the cooling system, and further comprising means for viewing the color of liquid flowing through said hose.

10. The hoses of claim 9 wherein said viewing means is mounted on a housing adapted for installation at the same level as the upper section of a radiator and further comprising:

(a) means mounted on said housing for measuring the level of liquid in said housing, and (b) means mounted on said housing for measuring the specific gravity of liquid is said housing.

11. The hoses of claim 10 further comprising:

(a) means mounted on said housing for indicating the temperature of liquid within said housing, (b) means mounted on said housing for indicating the pressure within said housing, and (c) means mounted on said housing for indicating whether liquid is flowing through said housing.

12. The hoses of claim 7 wherein said dye is a liquid soluble dye.

* * * * *